US005133327A

United States Patent [19]

Hirosawa et al.

[11] Patent Number: 5,133,327

[45] Date of Patent: Jul. 28, 1992

[54] AIR FLOW SYSTEM HAVING CONSTANT DISCHARGE VOLUME

[75] Inventors: Koichiro Hirosawa; Hiroshi Kubo, both of Kariya, Japan

[73] Assignee: Aisin Seiki Kabushiki Kaisha, Kariya, Japan

[21] Appl. No.: 677,426

[22] Filed: Mar. 29, 1991

[30] Foreign Application Priority Data

Mar. 31, 1990 [JP] Japan ..... 2-87172

[51] Int. Cl.[5] ..... F02B 33/00

[52] U.S. Cl. ..... 123/564; 415/26; 415/27; 417/310

[58] Field of Search ..... 415/26, 27, 47; 417/310, 307, 199.1, 206; 123/564; 60/611

[56] References Cited

U.S. PATENT DOCUMENTS 4,498,429 2/1985 Satow et al. ..... 123/564 X
4,802,456 2/1989 Okane et al. ..... 123/564

FOREIGN PATENT DOCUMENTS 0019015 2/1979 Japan ..... 60/611
0142823 7/1987 Japan ..... 123/564
0038614 2/1988 Japan ..... 123/564
0179127 7/1988 Japan ..... 123/564

*Primary Examiner*—Edward K. Look
*Assistant Examiner*—Todd Mattingly
*Attorney, Agent, or Firm*—Oblon, Spivak, McClelland, Maier & Neustadt

[57] ABSTRACT

An air flow system includes a supercharger, a bypass passageway connected between an intake side and a discharge side of the supercharger, a compression machine and an air bypass valve in the bypass passageway. An intake port of the compression machine is connected with the bypass passageway such that supercharged air is delivered to the intake port of the compression machine at least during high supercharging conditions, thereby increasing the volumetric efficiency of the compressor at high engine speeds.

3 Claims, 5 Drawing Sheets

AIR FLOW SYSTEM HAVING CONSTANT DISCHARGE VOLUME

BACKGROUND OF INVENTION

1. Field of the Invention

The present invention relates to an air flow system which includes a machine which compresses or conveys fluid and can be used as a compressor, pump or actuator.

2. Description of the Related Art

A known air flow system includes a machine which compresses or conveys fluid by making use of changes in the volume of a compression chamber formed by a movable body and the inner wall of a casing, the changes being brought about by movement of a movable body. The movable body consists of a diaphragm. Rotary movement of a driving shaft transmits reciprocation to a rod, and the rod transmits the movement to the diaphragm.

FIG. 4 is a characteristic graph for a conventional compression machine. According to FIG. 4, as the rotation speed of the drive shaft increases, the volumetric efficiency in the compression machine decreases, so that the volume of gas discharged per rotation decreases.

FIG. 7 is the air intake system of an engine 41 with a conventional supercharger. According to FIG. 7, the supercharger 42 is driven by the rotation of the engine, and the compressed charge is fed to the engine cylinder 41*a*, so that output power of the engine is increased. When the discharged pressure from the supercharger reaches more than a predefined pressure, an air bypass valve 34 opens and the excess pressure is bypassed or returned to a point upstream of the supercharger.

The intake system also includes an air cleaner 36, an air flowmeter 37, an idle speed control valve (ISCV) 38, an intercooler 39 and an injector 40.

FIG. 3 is the characteristic graph of the above-mentioned supercharger. According to this supercharger, as the rotation speed of the engine increases, the volume of gas discharged per rotation increases, and a great amount of excess pressure is generated at high rotation speeds.

Thus, on the one hand, there is the problem that as the rotation speed increases, the volumetric efficiency of a compression machine decreases and, on the other hand, that as the rotation speed increases, the discharge volume of a supercharger increases so that the excess discharge must be relieved and so is wasted.

SUMMARY OF THE INVENTION

It is an object of the invention to provide a novel air flow system with a compression machine which is free of the foregoing problems.

The above, and other, objects are achieved according to the present invention by an air flow system including a supercharger having an intake side and a discharge side. A bypass passageway is connected between the intake side and the discharge side of the supercharger. A compression machine has an intake port and a discharge port. An air bypass valve in the bypass passageway selectively closes the bypass passageway. The bypass valve divides the bypass passageway into a suction portion and a discharge portion. The suction portion of the bypass passageway is connected to the intake side of the supercharger while the discharge portion of the bypass passageway is connected to the discharge side of the supercharger. Means are provided for connecting the intake port of the compression machine with the bypass passageway. An electronic controller comprises means for controlling the bypass valve to open during at least high supercharging conditions.

The air flow system having a compression machine, constructed as described above, acts such that the air compression machine and the supercharger complement each other to minimize the disadvantages due to the characteristics of both the compression machine and the supercharger. That is, the supercharged pressure (boost pressure) of the supercharger is introduced to the intake of the compression machine via the communication pipe so that the volumetric efficiency of the compression machine improves. As a result of this, the discharge volume thereof is improved at high speeds.

DETAILED DESCRIPTION OF THE PREFERRED EMBODIMENTS

Figure 6:
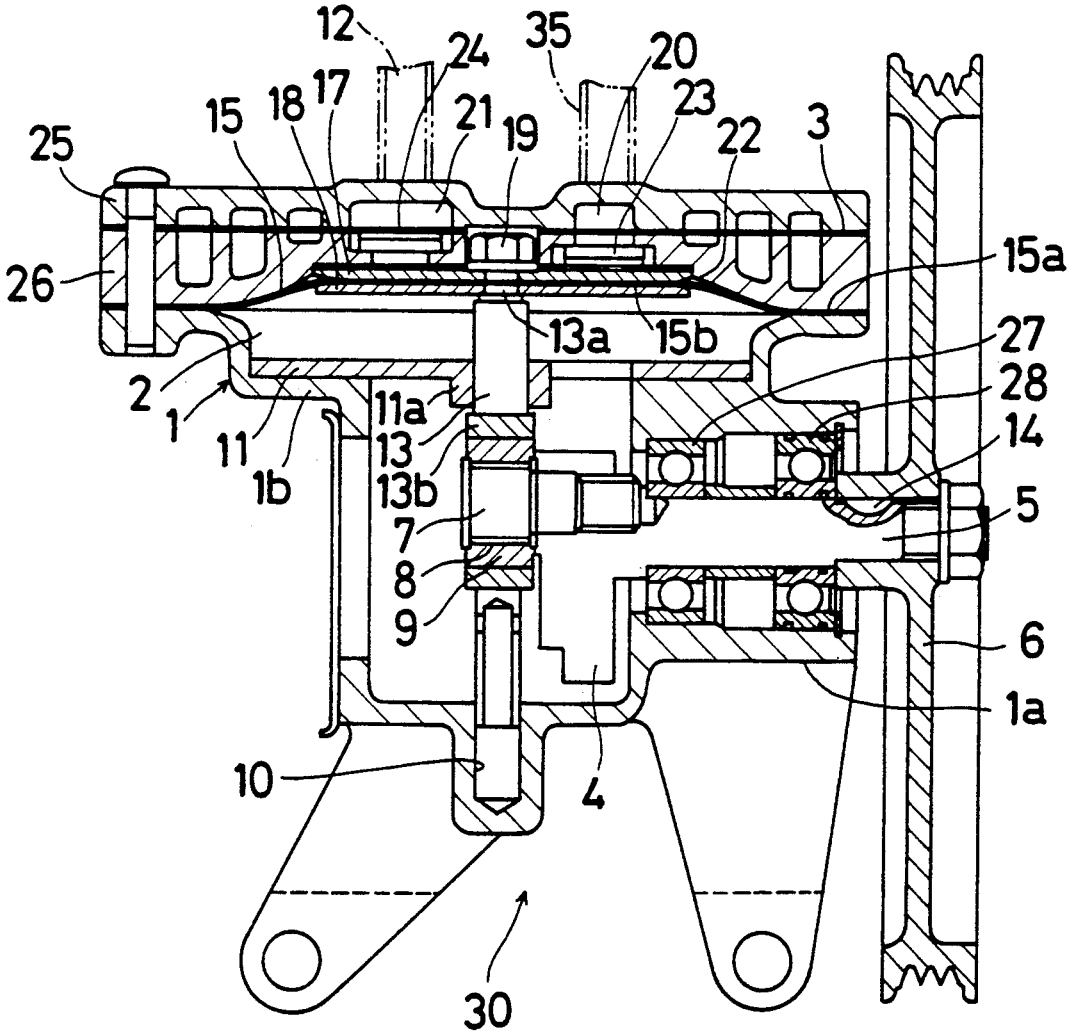
FIG. 6 is a vertical cross section of a compression machine according to the present invention.
Figure 7:
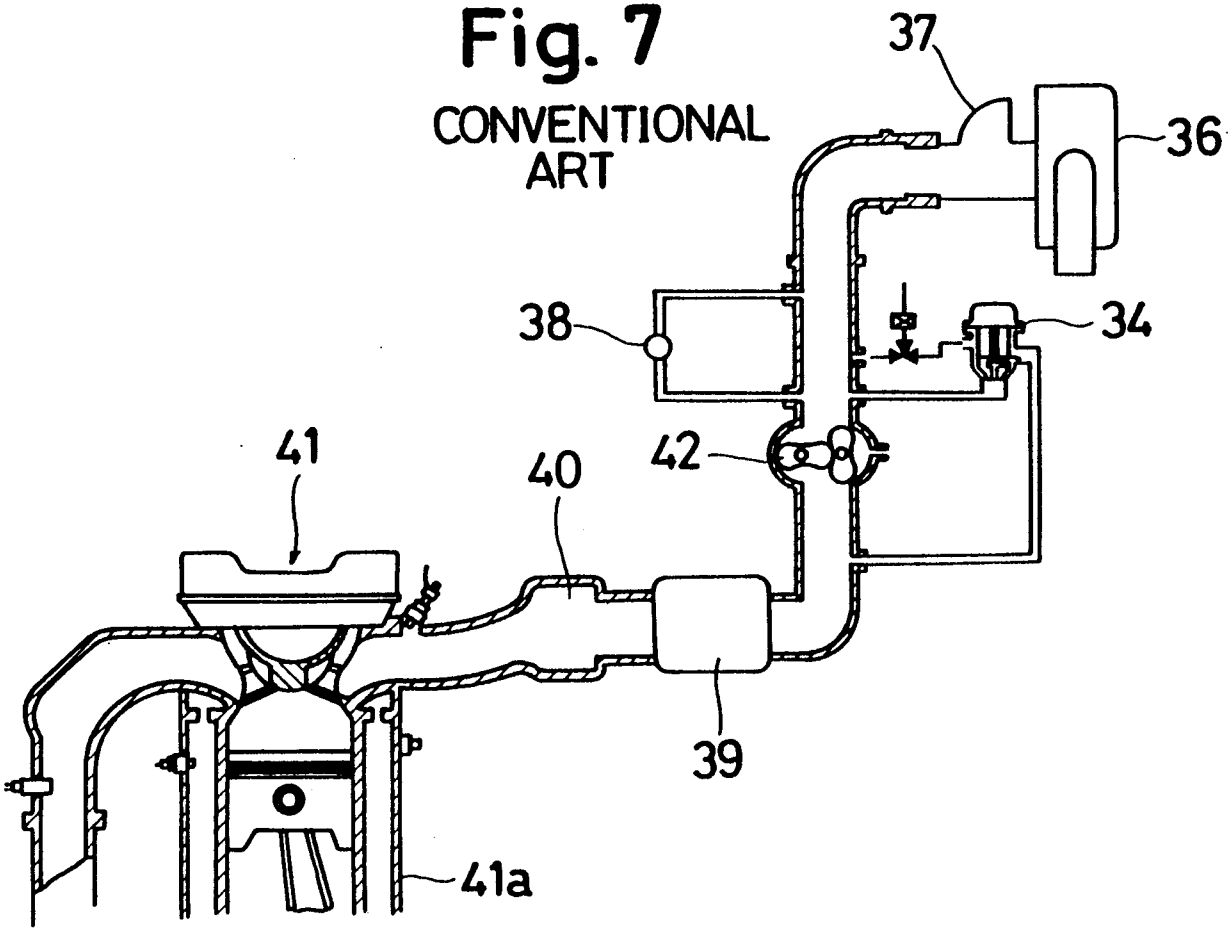
Fig. 7 CONVENTIONAL ART
FIG. 7 is a schematic illustration of an engine with a conventional supercharger.

Referring to FIG. 6, there is shown a diaphragm type compression machine 30 according to the invention. This machine includes a case, generally indicated by reference numeral 1. The case 1 and a valve case 26 together form a casing 2. A movable body or diaphragm 15 is accommodated in the casing 2. The diaphragm 15 has a fringe portion 15*a* and a central portion 15*b*. The fringe portion 15*a* is held between the cases 1 and 26 while the central portion 15*b* is held between two supports 17 and 18. The diaphragm 15 and the valve case 26 together form a chamber 22. An upper case 25 is attached via a gasket 3 to the surface of the valve case 26 that is opposite to the chamber 22.

A rod 13 extends through the supports 17 and 18 which are fixed to the end 13*a* of the rod 13 by a nut 19. The rod 13 is provided at its central portion with a slot 13*b*. The slot 13*b* is oblong, i.e., elongate in a direction transverse to the length of the rod. An annular roller 9 slides in the slot 13*b*. A shaft 7 fits in the roller 9 via a bearing 8 and is eccentrically mounted to an input shaft 5. When the input shaft 5 turns, the axis of the shaft 7 then rotates around the central axis of the input shaft 5. A counterweight 4 is formed at the front end of the shaft 5 to maintain stable rotation thereof in spite of unbalanced centrifugal force arising from the rotation of the shaft 7.

The case 1 has a step portion 1*b* on which a surface of the support 11 is mounted. The rod 13 is slidably mounted in a boss 11*a* of the support 11 and a hole 10 formed in the case 1 such that the rod 13 is constrained to slide up and down as viewed in the figure.

The input shaft 5 is rotatably mounted in the boss 1*a* of the case 1 via bearings 27 and 28. A woodruff key 14 is fixed to the ear end of the input shaft to lock a pulley 6 against rotary movement relative thereto.

An intake port 20 and a discharge port 21 are formed in both valve case 26 and upper case 25. Reed valves 23 and 24 are mounted in the ports 20 and 21, respectively. These ports are selectively communicated with chamber 22 by the reed valves 23 and 24, respectively.

Figure 1:
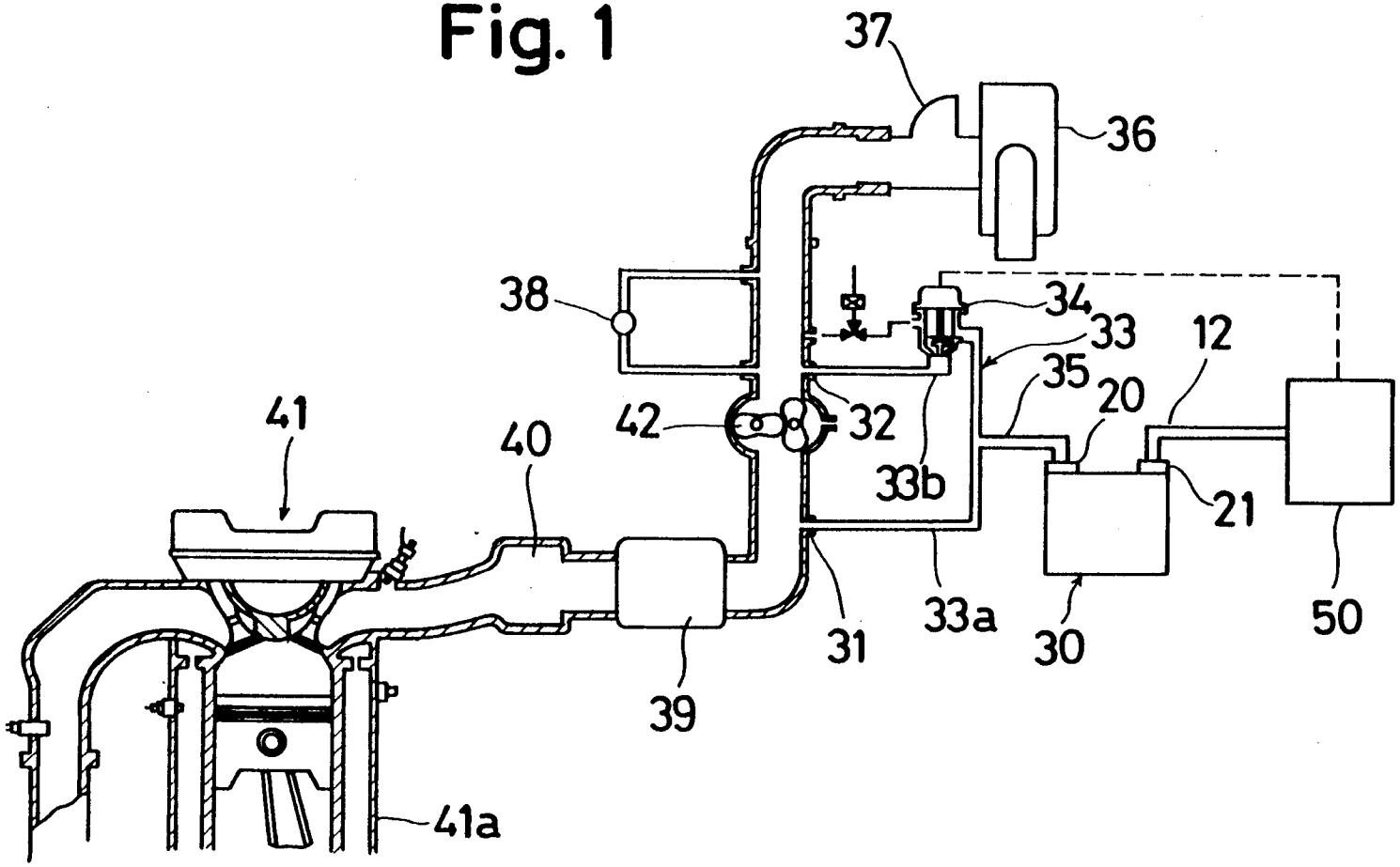
FIG. 1 is a schematic illustration of a system including a compression machine according to an embodiment of the present invention.

FIG. 1 is a schematic view of a system with which the above-mentioned compression machine 30 is employed.

An engine 41 is provided with a roots type blower or supercharger 42 in its air intake passage. This supercharger 42 is driven by engine power and supplies pressurized air to the engine cylinder 41*a*. A connecting gate 31 disposed at the discharge side of the supercharger 42 and the connecting gate 32 at the suction side of the supercharger 42 are connected via a bypass passageway 33. This bypass passageway 33 is divided into a discharge side bypass portion 33*a* and a suction side bypass 33*b* portion by an air bypass valve 34 such that both bypass portions 33*a* and 33*b* are selectively connected to each other.

The air bypass valve 34 is opened or shut by an electropneumatic controller 50, depending on the desired state of non-supercharging, supercharging or high power supercharging.

This bypass passageway 33 is in fluid communication with the intake port 20 of the compression machine 30 via the communication pipe 35. That is, the intake port 20 is connected with the discharge side bypass portion 33*a*, and so is always connected with the discharge side of the supercharger 42.

The discharge port 21 is connected with the discharge pipe 12, and so the air which is discharged through the discharge port 21 is sent to the controller 50 via the discharge pipe 12 for controlling the bypass valve 34.

Referring back to FIG. 6, in the operation of the compression machine constructed as described thus far, the power transmitted to the pulley 6 from a driving machine (not shown but may be the engine 41) rotates the input shaft 5, thereby rotating the shaft 7 around the axis of the input shaft 5. This causes the roller 9 to move upwardly and downwardly. At this time, the roller 9 also slides horizontally in the slot 13*b*.

The vertical movement of the roller 9 drives the rod 13 upwardly or downwardly. The movement of the rod 13 is transmitted via the supports 17 and 18 to the diaphragm 15, which is moved upwardly or downwardly. Then, the volume of the chamber 22 is varied to repeatedly suck and discharge the fluid through the ports.

During the suction stroke, downward movement of the diaphragm 15 increases the volume of the chamber 22 to open the reed valve 23 in the intake port 20, thus permitting the fluid to flow into the chamber 22. During this process, the reed valve 24 on the discharge side is kept closed by the pressure difference between the discharge port 21 and the chamber 22.

During the discharge stroke, upward movement of the diaphragm 15 reduces the volume of the chamber 22. The fluid in the chamber opens the reed valve 24 and flows out through the discharge port 21. During this process, the reed valve 23 is kept closed.

The movement of the compression machine 30 operates as follows:

(i) Non-supercharging

Under this condition the supercharger 42 does not operate, and the passageway 33 having the supercharger is closed thereby. On the other hand, the air bypass valve 34 is opened by the controller 50 and the air is supplied to the engine cylinder 41a via the bypass passageway 33.

The intake port 20 of the compression machine 30 is thus supplied with air which is not under pressure.

(ii) Supercharging

Under this condition, the supercharger 42 operates, the air bypass valve 34 is shut by the controller 50, the air introduced via the air cleaner 36 is pressurized via the supercharger 42, and the pressurized air is introduced into the intake port 20 of the compression machine 30. Thus, the supercharger supercharges the compressor, to improve its volumetric efficiency.

(iii) High supercharging

Under this condition, the air bypass valve 34 is opened by the controller 50 and excess supercharged pressure returns to the suction side via bypass passageway 33.

The constant supercharged pressure is introduced into the intake port 20 of the compression machine 30 to improve its volumetric efficiency.

Figure 5:
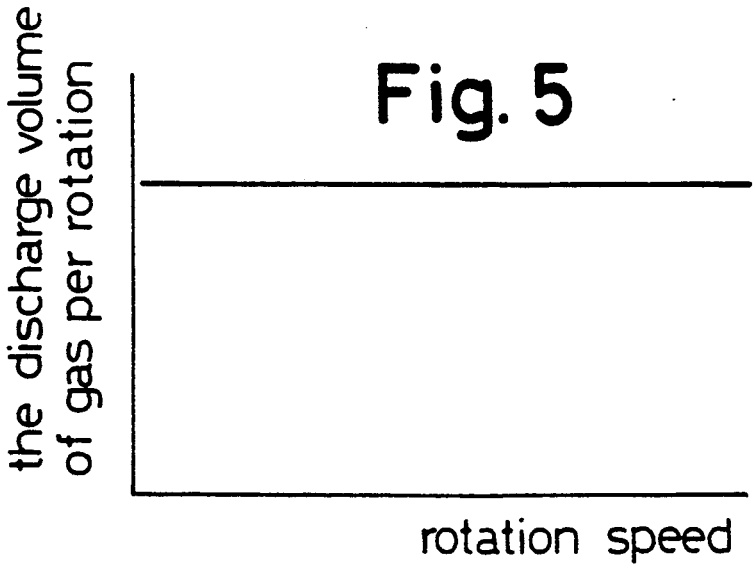
FIG. 5 is a characteristic graph according to the compression machine of the present invention.

FIG. 5 is the characteristic graph of the compression machine 30 of this invention in the state of supercharging which is above-mentioned item (ii). The volume of discharge of the compression machine 30, which decreases as the rotation speed of the engine increases, is compensated for by the volume of discharge of the supercharger, which increases as the rotation speed of the engine increases, via the communication pipe 35. As a result of this, the compression machine 30 of the present invention can keep the discharge volume constant and independent of the variation of the engine speed. Of course, during high supercharging (item (iii)) the compressor 30 also receives compressed air from the bypass passageway, and so the discharge volume is maintained at a high level.

Figure 2:
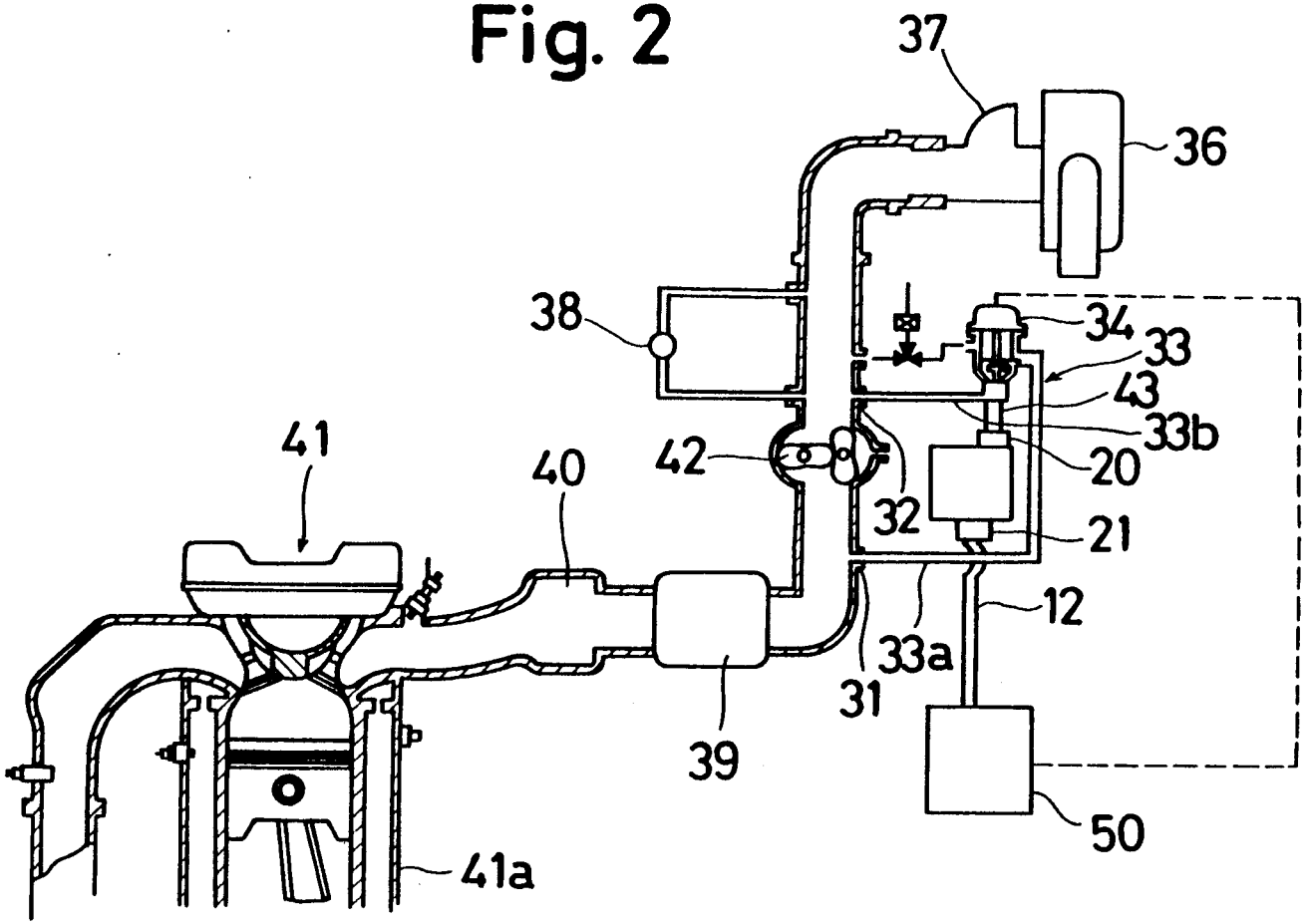
FIG. 2 is a schematic illustration of another system including a compression machine according to another embodiment of the present invention.
Figure 3:
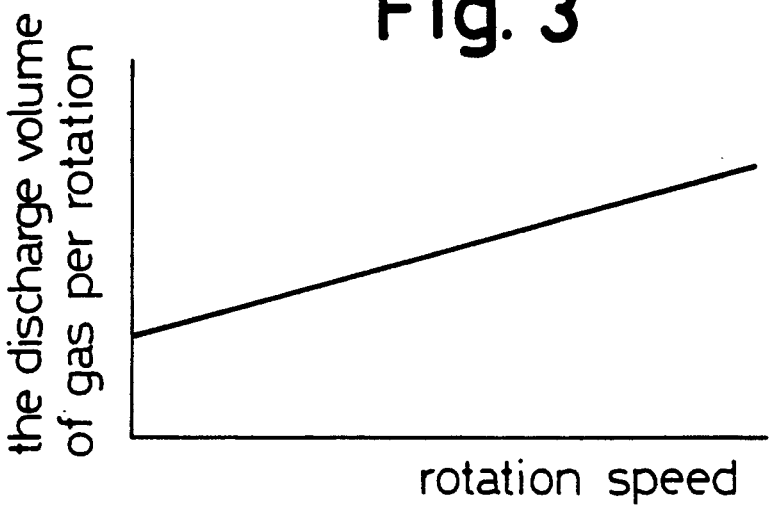
FIG. 3 is a general characteristic graph according to a conventional supercharger.
Figure 4:
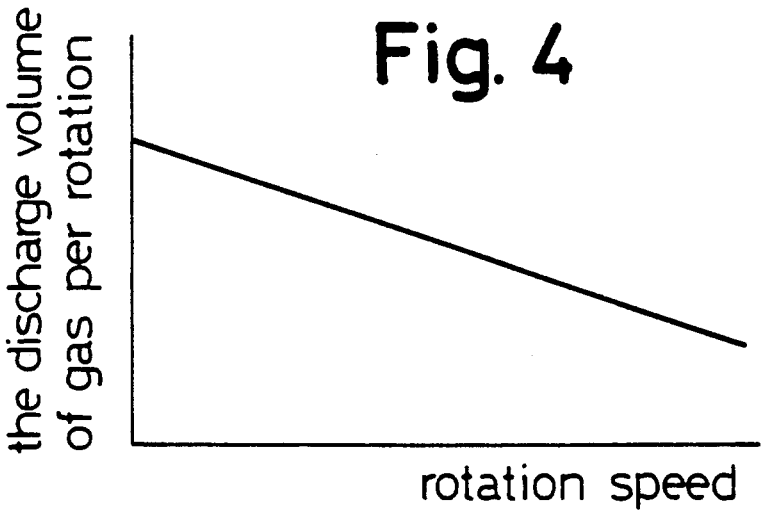
FIG. 4 is a general characteristic graph according to a conventional compression machine.

FIG. 2 is another embodiment of the present invention. This embodiment differs from the above-mentioned embodiment in that the intake port 20 of the compression machine 30 is connected with the intake side of the supercharger. That is, the suction side bypass passageway 33*b* and the intake port 20 are fluidically connected by the communicating pipe 43. The intake pipe port 20 always connects to the intake side of the supercharger 42.

Under non-supercharged or supercharged conditions the air bypass valve 34 is closed and non-pressurized air is introduced into the intake port 20. Under high supercharging (when valve 34 opens), the constant supercharged pressure air is introduced into the intake port 20 through the discharge side bypass passageway 33*b*.

As described thus far, in a novel compression machine, the excess energy from the supercharger is used efficiently, and a constant discharge flow is for stable operation and accurate control.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An air flow system comprising:

a supercharger having an intake side and a discharge side;

a bypass passageway connected between said intake side and said discharge side of said supercharger;

a mechanically driven compression machine having an intake port and a discharge port and comprising means for sucking a gas through said intake port, compressing the sucked gas and discharging the compressed gas through said discharge port;

an air bypass valve in said bypass passageway and selectively closing said bypass passageway, said air bypass valve dividing said bypass passageway into a suction portion and a discharge portion, the suction portion of the bypass passageway being connected to the intake side of the supercharger and the discharge portion of the bypass passageway being connected to the discharge side of the supercharger;

means for connecting the intake port of the compression machine with the bypass passageway; and an electronic controller receiving compressed gas from the discharge port of the compressing machine and comprising means for controlling the air bypass valve to open during at least high supercharging conditions so that supercharged air is delivered to the intake port of said compression machine.

2. The system of claim 1, wherein said connecting means comprise a conduit connected to the discharge portion of said bypass passageway and said electronic controller controls the air bypass valve to pen during non-supercharging conditions.

3. The system of claim 1, wherein said connecting means comprise a conduit connected to the suction portion of said bypass passageway.

* * * * *